US007538049B2

(12) United States Patent
Köhnen

(10) Patent No.: US 7,538,049 B2
(45) Date of Patent: May 26, 2009

(54) AIRBAG FABRIC

(75) Inventor: Ralf Köhnen, Congleton (GB)

(73) Assignee: Polyamide High Performance GmbH, Wuppertal (DE)

( * ) Notice: Subject to any disclaimer, the term of this patent is extended or adjusted under 35 U.S.C. 154(b) by 105 days.

(21) Appl. No.: 11/661,970

(22) PCT Filed: May 13, 2006

(86) PCT No.: PCT/EP2006/004527

§ 371 (c)(1),
(2), (4) Date: Apr. 24, 2007

(87) PCT Pub. No.: WO2006/128566

PCT Pub. Date: Dec. 7, 2006

(65) Prior Publication Data

US 2008/0064283 A1 Mar. 13, 2008

(30) Foreign Application Priority Data

Jun. 2, 2005 (EP) ..... 05011877

(51) Int. Cl.
*D03D 13/00* (2006.01)

(52) U.S. Cl. ..... 442/203; 280/728.1; 442/189; 139/432; 139/383 R; 139/384 R; 139/387 R

(58) Field of Classification Search ..... 280/728.1; 442/203, 205, 207, 189; 139/432, 383 R, 139/384 R, 387 R, 389, 392
See application file for complete search history.

(56) References Cited

U.S. PATENT DOCUMENTS

| | | | | |
|---|---|---|---|---|
| 4,256,148 | A | 3/1981 | Scharling, II | |
| 5,657,798 | A | 8/1997 | Krummheuer et al. | |
| 5,937,915 | A | 8/1999 | Wahhoud | |
| 2005/0011578 | A1 | 1/2005 | Walsh et al. | |
| 2008/0042413 | A1 * | 2/2008 | Coleman et al. | 280/743.1 |

FOREIGN PATENT DOCUMENTS

| | | | | |
|---|---|---|---|---|
| DE | 296 15 402 | U1 | | 12/1996 |
| DE | 196 53 028 | C1 | | 1/1998 |
| DE | 198 07 572 | A1 | | 8/1999 |
| DE | 103 28 632 | A1 | | 1/2005 |
| EP | 0 458 838 | B1 | * | 12/1990 |
| EP | 0 738 793 | A1 | | 10/1996 |
| EP | 1 475 475 | A1 | | 11/2004 |
| WO | WO 90/09295 | | | 8/1990 |
| WO | WO 03/078711 | A1 | | 9/2003 |

* cited by examiner

*Primary Examiner*—Arti Singh-Pandey
(74) *Attorney, Agent, or Firm*—Oliff & Berridge, PLC

(57) ABSTRACT

Airbag fabric with warp and weft yarns in which at least most of the weft yarns in the fabric comprise at least two contiguous yarns, characterised in that at least one of the contiguous yarns is an intermingled multifilament yarn, some filaments of the multifilament yarn being intermingled with some filaments of the yarns adjacent to it.

8 Claims, No Drawings

AIRBAG FABRIC

The invention relates to an airbag fabric with warp and weft yarns, at least most of the weft yarns in the fabric each comprising at least two contiguous yarns.

A fabric of this type is known from, for example, DE 198 07 572 A1. It is generally known that simultaneous insertion of two or more weft yarns into the same shed results in the inserted weft yarns having different lengths and/or different yarn tension, so that simultaneous insertion of the weft yarns gives rise to highly inhomogeneous fabrics that are not suitable for airbag production. DE 198 07 572 A1 therefore recommends that the weft yarns be inserted in succession into the same shed in the production of airbag fabrics. If the weft yarns are inserted into the shed in succession, the weaving efficiency is naturally reduced.

The object of the present invention is to provide an economically produced airbag fabric with warp and weft yarns in which at least most of the weft yarns comprise at least two contiguous yarns.

This object is achieved by an airbag fabric with warp and weft yarns in which at least most of the weft yarns comprise at least two contiguous yarns, distinguished in that at least one of the contiguous yarns is an intermingled multifilament yarn, some filaments of the multifilament yarn being intermingled with some filaments of the yarns adjacent to it.

Because at least one weft yarn is an intermingled multifilament yarn, it is ensured that contiguous weft yarns remain as, and retain the character of, discrete yarns. Because individual filaments of a weft yarn are intermingled with individual filaments of the weft yarn adjacent to it, such yarns can now be jointly and simultaneously inserted into the shed. It is therefore clear that the fabric of the invention can be produced more economically.

The fabric of the invention can be produced by, for example, using as weft threads yarns that have previously been intermingled with one another, of which at least one must be an already intermingled yarn. It is considerably more cost effective to use the process described in DE 196 53 028 C1, where the weft yarn, prior to intermediate storage, is intermingled with an intermingling unit. To obtain the fabric of the invention, it is necessary merely to feed simultaneously into the intermingling unit described in DE 196 53 028 C1 those yarns of the fabric that are to be inserted alongside one another into the shed. This intermingling ensures that the contiguous yarns have at least approximately the same length and the same tension after insertion into the shed, and that, because at least one of these yarns had previously been intermingled, the yarns in the finished fabric are still recognisable as distinct, contiguous yarns, so that the fabrics are comparable with those in which adjacent weft threads have been inserted in succession. The fabrics of the invention are however distinguished from known fabrics in that at least some filaments of the contiguous weft yarns are intermingled with one another.

The object of the invention is also achieved by a fabric having at least one upper and at least one lower fabric, the upper and lower fabrics being interwoven in selected regions to form a single fabric, wherein at least most of the weft threads in the upper and lower fabrics comprise at least two contiguous yarns, characterised in that at least one of the contiguous yarns is an intermingled multifilament yarn, some filaments of the multifilament yarn being intermingled with some filaments of the yarns adjacent to it. These fabrics also have the advantages described above.

In the fabric of the invention it has proved particularly advantageous if 5 to 25% of the filaments of each of the contiguous yarns are intermingled with one another. Extensive trials have shown that for intermingling in which fewer than 5% of the filaments of one yarn are intermingled with fewer than 5% of the filaments of a second yarn, the cohesion of the two yarns is insufficient for both yarns to be inserted jointly into the shed. If more than 25% of the filaments of the contiguous yarns are intermingled, the yarns lose their discrete identity as the number of intermingled filaments of contiguous yarns increases.

For the fabric of the invention, it is particularly advantageous if all contiguous weft yarns are intermingled multifilament yarns. The weft yarns that are used and intermingled can all be of the same material, such as a polyamide or a polyester. However, for fine tuning of specific properties in the fabric of the invention it can also be advantageous to intermingle yarns of different materials with one other.

The fabrics of the invention are distinguished particularly in that the warp and/or weft yarns have a linear density of 235 to 700 dtex and/or in that the individual filaments of the warp and/or weft yarns have a linear density not exceeding 5 dtex. Yarns such as are described in, for example, EP 0 738 793 A1 are particularly suitable for producing the fabric of the invention.

The invention claimed is:

1. An airbag fabric with warp and weft yarns in which at least most of the weft yarns in the fabric comprise at least two contiguous yarns, wherein at least one of the contiguous yarns is an intermingled multifilament yarn, some filaments of the multifilament yarn being intermingled with some filaments of the yarns adjacent to it.

2. Fabric having at least one upper and at least one lower fabric, the upper and lower fabrics being interwoven in selected regions to form a single fabric, wherein at least most of the weft threads in the upper and lower fabrics comprise at least two contiguous yarns, and wherein at least one of the contiguous yarns is an intermingled multifilament yarn, some filaments of the multifilament yarn being intermingled with some filaments of the yarns adjacent to it.

3. Fabric according to claim 1 wherein 5 to 25% of the filaments of each of the contiguous yarns are intermingled with one another.

4. Fabric according to claim 1, wherein all contiguous weft yarns are intermingled multifilament yarns.

5. Fabric according to claim 1, wherein the warp and/or weft yarns have a linear density of 235 to 700 dtex.

6. Fabric according to claim 1. wherein the individual filaments of the warp and/or weft yarns have a linear density not exceeding 5 dtex.

7. Fabric according to claim 1, wherein the warp yarns as well as each of the contiguous weft yarns have the same linear density.

8. An airbag comprising the fabric of claim 1.

* * * * *